US007704354B2

(12) United States Patent
Sandoval et al.

(10) Patent No.: US 7,704,354 B2
(45) Date of Patent: Apr. 27, 2010

(54) METHOD AND APPARATUS FOR ELECTROWINNING COPPER USING THE FERROUS/FERRIC ANODE REACTION

(75) Inventors: Scot Philip Sandoval, Morenci, AZ (US); Timothy George Robinson, Scottsdale, AZ (US); Paul Richard Cook, Morenci, AZ (US)

(73) Assignee: Freeport-McMoran Corporation, Phoenix, AZ (US)

( * ) Notice: Subject to any disclaimer, the term of this patent is extended or adjusted under 35 U.S.C. 154(b) by 0 days.

(21) Appl. No.: 12/126,552

(22) Filed: May 23, 2008

(65) Prior Publication Data

US 2008/0217169 A1 Sep. 11, 2008

Related U.S. Application Data

(62) Division of application No. 10/629,497, filed on Jul. 28, 2003, now Pat. No. 7,378,011.

(51) Int. Cl.
*C25C 7/00* (2006.01)
*C25C 1/12* (2006.01)

(52) U.S. Cl. ..... 204/275.1; 205/575

(58) Field of Classification Search ..... None
See application file for complete search history.

(56) References Cited

U.S. PATENT DOCUMENTS 2,792,342 A * 5/1957 Tuwiner ..... 205/577
3,972,795 A * 8/1976 Goens et al. ..... 204/269
5,492,608 A * 2/1996 Sandoval et al. ..... 204/237
5,622,615 A * 4/1997 Young et al. ..... 205/582

* cited by examiner

*Primary Examiner*—Harry D Wilkins, III
(74) *Attorney, Agent, or Firm*—Snell & Wilmer L.L.P.

(57) ABSTRACT

The present invention relates, generally, to a method and apparatus for electrowinning metals, and more particularly to a method and apparatus for copper electrowinning using the ferrous/ferric anode reaction. In general, the use of a flow-through anode—coupled with an effective electrolyte circulation system—enables the efficient and cost-effective operation of a copper electrowinning system employing the ferrous/ferric anode reaction at a total cell voltage of less than about 1.5 V and at current densities of greater than about 26 Amps per square foot (about 280 A/m$^2$), and reduces acid mist generation. Furthermore, the use of such a system permits the use of low ferrous iron concentrations and optimized electrolyte flow rates as compared to prior art systems while producing high quality, commercially saleable product (i.e., LME Grade A copper cathode or equivalent), which is advantageous.

8 Claims, 3 Drawing Sheets

METHOD AND APPARATUS FOR ELECTROWINNING COPPER USING THE FERROUS/FERRIC ANODE REACTION

CROSS REFERENCE TO RELATED APPLICATIONS

This application is a divisional application of U.S. application Ser. No. 10/629,497, filed Jul. 28, 2003 now U.S. Pat. No. 7,378,011 and entitled "Method And Apparatus for Electrowinning Copper Using the Ferrous/Ferric Anode Reaction," which application is hereby incorporated by reference herein in its entirety.

FIELD OF INVENTION

The present invention relates, generally, to a method and apparatus for electrowinning metals, and more particularly to a method and apparatus for copper electrowinning using the ferrous/ferric anode reaction.

BACKGROUND OF THE INVENTION

Efficiency and cost-effectiveness of copper electrowinning is and for a long time has been important to the competitiveness of the domestic copper industry. Past research and development efforts in this area have thus focused—at least in part—on mechanisms for decreasing the total energy requirement for copper electrowinning, which directly impacts the cost-effectiveness of the electrowinning process.

Conventional copper electrowinning, wherein copper is plated from an impure anode to a substantially pure cathode with an aqueous electrolyte, occurs by the following reactions:

Cathode Reaction:

$$Cu^{2+}+SO_4^{2-}+2e^-\rightarrow Cu^0+SO_4^{2-}(E^0=+0.345\ V)$$

Anode Reaction:

$$H_2O\rightarrow \tfrac{1}{2}O_2+2H^++2e^-(E^0=-1.230\ V)$$

Overall Cell Reaction:

$$Cu^{2+}+SO_4^{2-}+H_2O\rightarrow Cu^0+2H^++SO_4^{2-}+\tfrac{1}{2}O_2(E^0=-0.855\ V)$$

Conventional copper electrowinning according to the above reactions, however, exhibits several areas of potential improvement for, among other things, improved economics, increased efficiency, and reduced acid mist generation. First, in conventional copper electrowinning, the decomposition of water reaction at the anode produces oxygen ($O_2$) gas. When the liberated oxygen gas bubbles break the surface of the electrolyte bath, they create an acid mist. Reduction or elimination of acid mist is desirable. Second, the decomposition of water anode reaction used in conventional electrowinning contributes significantly to the overall cell voltage via the anode reaction equilibrium potential and the overpotential. The decomposition of water anode reaction exhibits a standard potential of 1.23 Volts (V), which contributes significantly to the total voltage required for conventional copper electrowinning. The typical overall cell voltage is approximately 2.0 V. A decrease in the anode reaction equilibrium potential and/or overpotential would reduce cell voltage, and thus conserve energy and decrease the total operating costs of the electrowinning operation.

One way that has been found to potentially reduce the energy requirement for copper electrowinning is to use the ferrous/ferric anode reaction, which occurs by the following reactions:

Cathode Reaction:

$$Cu^{2+}+SO_4^{2-}+2e^-\rightarrow Cu^0+SO_4^{2-}(E^0=+0.345\ V)$$

Anode Reaction:

$$2Fe^{2+}\rightarrow 2Fe^{3+}+2e^-(E^0=-0.770\ V)$$

Overall Cell Reaction:

$$Cu^{2+}+SO_4^{2-}+2Fe^{2+}\rightarrow Cu^0+2Fe^{3+}+SO_4^{2-}(E^0=-0.425\ V)$$

The ferric iron generated at the anode as a result of this overall cell reaction can be reduced back to ferrous iron using sulfur dioxide, as follows:

Solution Reaction:

$$2Fe^{3+}+SO_2+2H_2O\rightarrow 2Fe^{2+}+4H^++SO_4^{2-}$$

The use of the ferrous/ferric anode reaction in copper electrowinning cells lowers the energy consumption of those cells as compared to conventional copper electrowinning cells that employ the decomposition of water anode reaction, since the oxidation of ferrous iron ($Fe^{2+}$) to ferric iron ($Fe^{3+}$) occurs at a lower voltage than does the decomposition of water. However, maximum voltage reduction—and thus maximum energy reduction—cannot occur using the ferrous/ferric anode reaction unless effective transport of ferrous iron and ferric iron to and from, respectively, the cell anode(s) is achieved. This is because the oxidation of ferrous iron to ferric iron in a copper electrolyte is a diffusion-controlled reaction. This principle has been recognized and applied by, among others, the U.S. Bureau of Mines Reno Research Center and Sandoval et al. in U.S. Pat. No. 5,492,608, entitled "Electrolyte Circulation Manifold for Copper Electrowinning Cells Which Use the Ferrous/Ferric Anode Reaction."

Although, in general, the use of the ferrous/ferric anode reaction in connection with copper electrowinning is known, a number of deficiencies are apparent in the prior art regarding to the practical implementation of the ferrous/ferric anode reaction in copper electrowinning processes. For example, prior embodiments of the ferrous/ferric anode reaction in copper electrowinning operations generally have been characterized by operating current density limitations, largely as a result of the inability to obtain a sufficiently high rate of diffusion of ferrous iron to the anode and ferric iron from the anode. Stated another way, because these prior applications have been unable to achieve optimum transport of ferrous and ferric ions to and from the anode(s) in the electrochemical cell, prior applications of the ferrous/ferric anode reaction have been unable to cost effectively produce copper cathode in electrochemical cells employing largely conventional structural features.

SUMMARY OF THE INVENTION

The present invention relates to an improved copper electrowinning process and apparatus designed to address, among other things, the aforementioned deficiencies in prior art electrowinning systems. The improved process and apparatus disclosed herein achieves an advancement in the art by providing a copper electrowinning system that, by utilizing the ferrous/ferric anode reaction in combination with other aspects of the invention, enables significant enhancement in electrowinning efficiency, energy consumption, and reduction of acid mist generation as compared to conventional copper electrowinning processes and previous attempts to apply the ferrous/ferric anode reaction to copper electrowinning operations. As used herein, the term "alternative anode reaction" refers to the ferrous/ferric anode reaction, and the term "alternative anode reaction process" refers to any electrowinning process in which the ferrous/ferric anode reaction is employed.

Enhancing the circulation of electrolyte in the electrowinning cell between the electrodes facilitates transport of copper ions to the cathode, increases the diffusion rate of ferrous iron to the anode, and facilitates transport of ferric iron from the anode. Most significantly, as the diffusion rate of ferrous iron to the anode increases, the overall cell voltage generally decreases, resulting in a decrease in the power required for electrowinning the copper using an alternative anode reaction process.

While the way in which the present invention addresses these deficiencies and provides these advantages will be discussed in greater detail below, in general, the use of a flow-through anode—coupled with an effective electrolyte circulation system—enables the efficient and cost-effective operation of a copper electrowinning system employing the ferrous/ferric anode reaction at a total cell voltage of less than about 1.5 V and at current densities of greater than about 26 Amps per square foot (about 280 $A/m^2$), and reduces acid mist generation. Furthermore, the use of such a system permits the use of low ferrous iron concentrations and optimized electrolyte flow rates as compared to prior art systems while producing high quality, commercially saleable product (i.e., LME Grade A copper cathode or equivalent), which is advantageous.

In accordance with one aspect of an exemplary embodiment of the invention, an electrochemical cell is configured such that copper electrowinning may be achieved in an alternative anode reaction process while maintaining a current density of greater than about 26 $A/ft^2$ (280 $A/m^2$) of active cathode.

In accordance with another aspect of an exemplary embodiment of the invention, an electrochemical cell is configured such that the cell voltage is maintained at less than about 1.5 V during the operation of an alternative anode reaction process.

In accordance with an aspect of yet another exemplary embodiment of the invention, an alternative anode reaction process is operated such that the concentration of iron in the electrolyte is maintained at a level of from about 10 to about 60 grams per liter.

In accordance with an aspect of yet another exemplary embodiment of the invention, an alternative anode reaction process is operated such that the temperature is maintained at from about 110° F. (about 43° C.) to about 180° F. (about 83° C.).

These and other features and advantages of the present invention will become apparent to those skilled in the art upon a reading of the following detailed description when taken in conjunction with the drawing figures, wherein there is shown and described various illustrative embodiments of the invention.

BRIEF DESCRIPTION OF THE DRAWING FIGURES

The subject matter of the present invention is particularly pointed out and distinctly claimed in the concluding portion of the specification. A more complete understanding of the present invention, however, may best be obtained by referring to the detailed description and to the claims when considered in connection with the drawing figures, wherein like numerals denote like elements and wherein:

DETAILED DESCRIPTION OF THE INVENTION

The present invention exhibits significant advancements over prior art processes, particularly with regard to process efficiency, process economics, and reduction of acid mist generation. Moreover, existing copper recovery processes that utilize conventional electrowinning process sequences may, in many instances, easily be retrofitted to exploit the many commercial benefits the present invention provides.

Figure 1:
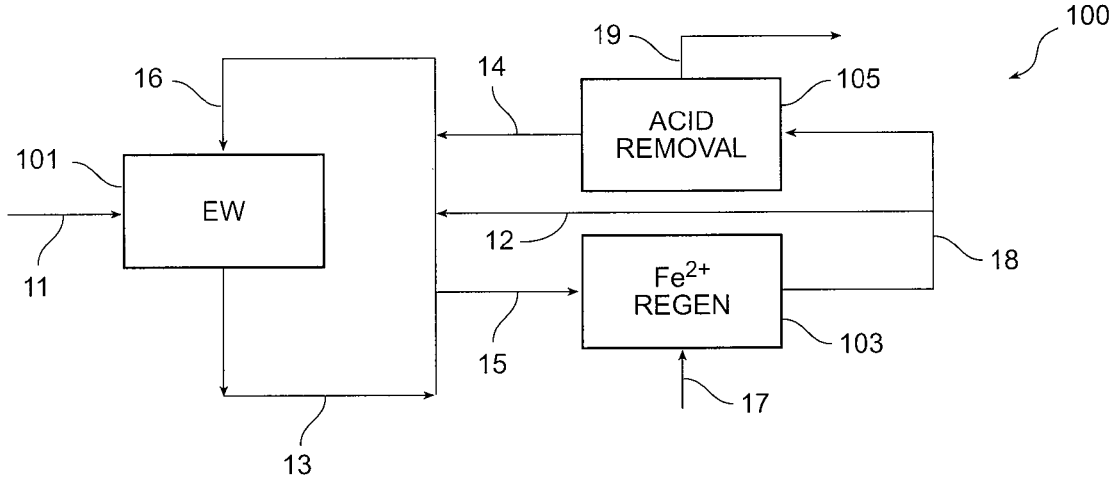
FIG. 1 is a flow diagram for an electrowinning process in accordance with one embodiment of the present invention.

With initial reference to FIG. 1, an electrowinning process 100 illustrating various aspects of an exemplary embodiment of the invention is provided. Electrowinning process 100 generally comprises an electrowinning stage 101, a ferrous iron regeneration stage 103, and an acid removal stage 105. Copper-rich commercial electrolyte 11 is introduced to electrowinning stage 101 for recovery of the copper therein. Electrowinning stage 101 produces cathode copper (stream not shown) and a ferric-rich electrolyte stream 13. At least a portion of ferric-rich electrolyte stream 13 is introduced into ferrous iron regeneration stage 103 as electrolyte regeneration stream 15. Manifold circulation stream 16 comprises the portion of ferric-rich electrolyte stream 13 not sent to ferrous iron regeneration stage 103, as well as recycle streams 12 and 14 from ferrous iron regeneration stage 103 and acid removal stage 105, respectively, and serves as a flow control and fluid agitation mechanism in accordance with one aspect of the invention discussed hereinbelow.

Generally speaking, increasing the operating current density in an electrowinning cell increases the cell voltage. This increased voltage demand translates into increased energy costs for producing copper, which affects the profitability of the electrowinning operation. On the other hand, certain other parameters in alternative anode reaction processes—such as, for example, temperature and iron concentration in the electrolyte—may be controlled in a manner that mitigates the effect of increased current density on cell voltage. For instance, as the temperature of the electrolyte is increased, cell voltage tends to decrease. Similarly, as the concentration of iron in the electrolyte increases, voltage tends to decrease in electrowinning cells employing the alternative anode reaction. Nevertheless, the mitigating effect of increased temperature and increased iron concentration on high cell voltage is limited.

In general, processes and systems configured according to various embodiments of the present invention enable the efficient and cost-effective utilization of the alternative anode reaction in copper electrowinning at a cell voltage of less than about 1.5 V and at current densities of greater than about 26 $A/ft^2$ (about 280 $A/m^2$). Furthermore, the use of such processes and/or systems reduces generation of acid mist and permits the use of low ferrous iron concentrations in the electrolyte and optimized electrolyte flow rates, as compared to prior art systems, while producing high quality, commercially saleable product.

While various configurations and combinations of anodes and cathodes in the electrochemical cell may be used effectively in connection with various embodiments of the invention, preferably a flow-through anode is used and electrolyte circulation is provided using an electrolyte flow manifold capable of maintaining satisfactory flow and circulation of electrolyte within the electrowinning cell.

In accordance with other exemplary embodiments of the invention, a system for operating an alternative anode reaction process includes an electrochemical cell equipped with at least one flow-through anode and at least one cathode, wherein the cell is configured such that the flow and circulation of electrolyte within the cell enables the cell to be advantageously operated at a cell voltage of less than about 1.5 V and at a current density of greater than about 26 A/ft$^2$. Various mechanisms may be used in accordance with the present invention to enhance electrolyte flow, as detailed herein. For example, an electrolyte flow manifold configured to inject electrolyte into the anode may be used, as well as exposed "floor mat" type manifold configurations and other forced-flow circulation means. In accordance with various embodiments of the invention, any flow mechanism that provides an electrolyte flow effective to transport ferrous iron to the anode, to transport ferric iron from the anode, and to transport copper ions to the cathode such that the electrowinning cell may be operated at a cell voltage of less than about 1.5 V and at a current density of greater than about 26 A/ft$^2$, is suitable.

These and other exemplary aspects of the present invention are discussed in greater detail hereinbelow.

In accordance with one aspect of the invention, ferrous iron, for example, in the form of ferrous sulfate ($FeSO_4$), is added to the copper-rich electrolyte to be subjected to electrowinning, to cause the ferrous/ferric ($Fe^{2+}/Fe^{3+}$) couple to become the anode reaction. In so doing, the ferrous/ferric anode reaction replaces the decomposition of water anode reaction. As discussed above, because there is no oxygen gas produced in the ferrous/ferric anode reaction, generation of "acid mist" as a result of the reactions in the electrochemical cell is eliminated. In addition, because the equilibrium potential of the $Fe^{2+}/Fe^{3+}$ couple (i.e., $E^0=-0.770$ V) is less than that for the decomposition of water (i.e., $E^0=-1.230$ V), the cell voltage is decreased, thereby decreasing cell energy consumption.

Moreover, as is discussed in greater detail hereinbelow, enhanced circulation of electrolyte between the electrodes increases the diffusion rate of ferrous iron to the anode. As the diffusion rate of ferrous iron to the anode increases, the overall cell voltage generally decreases, resulting in a decrease in the power required for electrowinning the copper.

Figure 2:
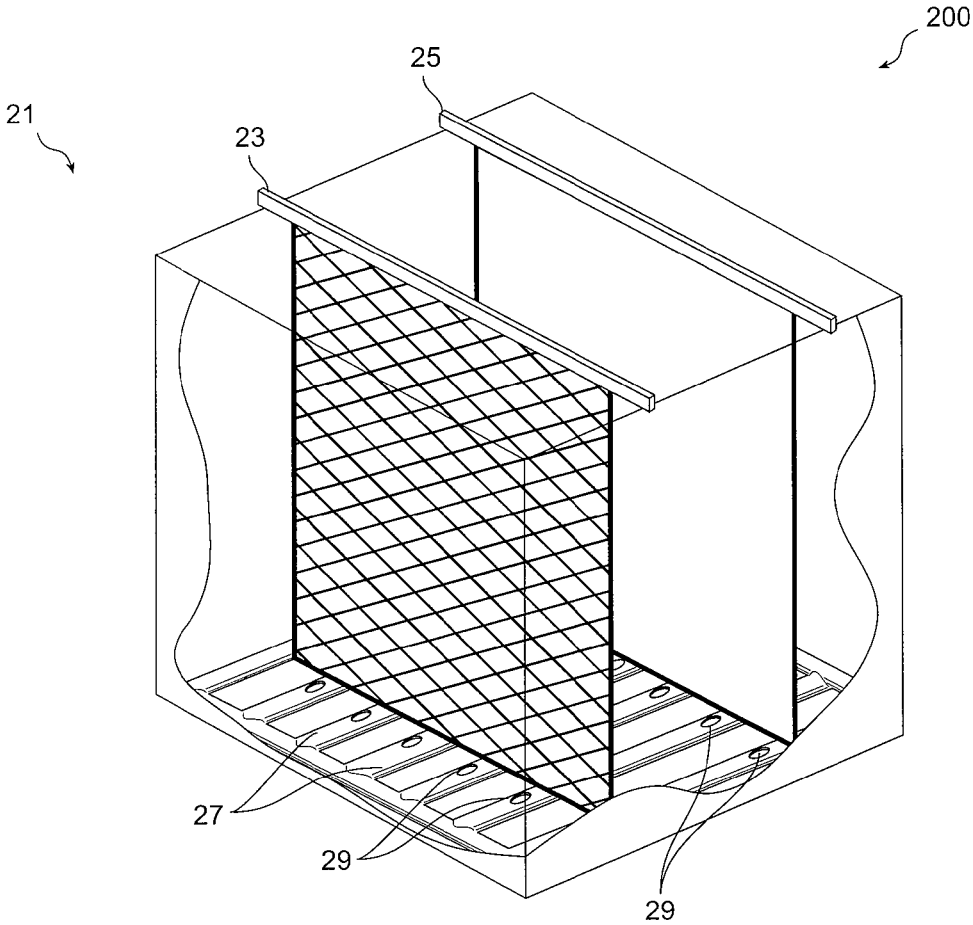
FIG. 2 illustrates an electrochemical cell configured to operate in accordance with one exemplary embodiment of the present invention.

In accordance with one exemplary embodiment of the present invention, a flow-through anode with an electrolyte injection manifold is incorporated into the cell as shown in FIG. 2. As used herein, the term "flow-through anode" refers to any anode configured to enable electrolyte to pass through it. While fluid flow from the manifold provides electrolyte movement, a flow-through anode allows the electrolyte in the electrochemical cell to flow through the anode during the electrowinning process. The use of a flow-through anode with manifold electrolyte injection decreases cell voltage at lower electrolyte flow rates, as compared to the prior art, and at lower electrolyte iron concentrations as compared to the prior art, through enhanced diffusion of ferrous iron to the anode. Prior art systems, for example, relied upon a "brute force" approach to increasing current density in electrowinning operations, elevating electrolyte flow rate, electrolyte temperature, and electrolyte iron concentration in their attempts. Prior art attempts, however, achieved maximum current densities of only up to 26 A/ft$^2$, and even then, average cell voltages were well above 1.0 V. Utilizing a flow-through anode in combination with effective electrolyte injection, however, the present inventors are able to operate electrowinning processes at current densities of 26 A/ft$^2$ and cell voltages of well below 1.0 V, while also dramatically decreasing the electrolyte flow rate and electrolyte iron concentration. Decreasing iron concentration without adversely affecting the efficiency or quality of the electrowinning operation is economically desirable, because doing so decreases iron make-up requirements and decreases the electrolyte sulfate saturation temperature, and thus decreases the cost of operating the electrowinning cell.

In accordance with various aspects of exemplary embodiments of the invention, electrolyte injection manifolds with bottom injection, side injection, and/or in-anode injection are incorporated into the cell to enhance ferrous iron diffusion. EXAMPLE 1 herein demonstrates the effectiveness of an in-anode electrolyte injection manifold for decreasing cell voltage.

In accordance with an exemplary embodiment of the invention, an overall cell voltage of less than about 1.5 V is achieved, preferably less than about 1.20 V or about 1.25 V, and more preferably less than about 0.9 V or about 1.0 V.

Generally speaking, as the operating current density in the electrochemical cell increases, the copper plating rate increases. Stated another way, as the operating current density increases, more cathode copper is produced for a given time period and cathode active surface area than when a lower operating current density is achieved. Alternatively, by increasing the operating current density, the same amount of copper may be produced in a given time period, but with less active cathode surface area (i.e., fewer or smaller cathodes, which corresponds to lower capital equipment costs and lower operating costs).

As current density increases using the ferrous/ferric anode reaction, cell voltage tends to increase due in part to the depletion of ferrous ions at the anode surface. This can be compensated for by increasing transport of ferrous ions to the anode as current density increases in order to maintain a low cell voltage. The prior art was limited to current densities of 26 A/ft$^2$ (280 A/m$^2$) and below for copper electrowinning using the ferrous/ferric anode reaction in large part because of ferrous iron transport limitations. Stated another way, previous attempts that increased flow rates and increased iron concentration in the electrolyte to achieve high current densities were unsuccessful in decreasing overall cell voltage. Various embodiments of the present invention allow for operation at current densities above—and significantly above—26 A/ft$^2$ while maintaining cell voltages of less than about 1.5 V.

As will be described in greater detail hereinbelow, exemplary embodiments of the present invention permit operation of electrochemical cells using the ferrous/ferric anode reaction at current densities of from about 26 to about 35 A/ft$^2$ at cell voltages of less than about 1.0 V; up to about 40 A/ft$^2$ at cell voltages of less than about 1.25 V; and up to about 50 A/ft$^2$ or greater at cell voltages of less than about 1.5 V.

In accordance with an exemplary embodiment of the invention, a current density of from about 20 to about 50 amps per square foot of active cathode (about 215 A/m$^2$ to about 538 A/m$^2$) is maintained, preferably greater than about 26 A/ft$^2$ (280 A/m$^2$), and more preferably greater than about 30 A/ft$^2$ (323 A/m$^2$) of active cathode. It should be recognized, however, that the maximum operable current density achievable in accordance with various embodiments of the present invention will depend upon the specific configuration of the process apparatus, and thus an operating current density in excess of 50 A/ft$^2$ (538 A/m$^2$) of active cathode may be achievable in accordance with the present invention.

One clear advantage of processes configured in accordance with various embodiments of the present invention is that a higher current density as compared to the prior art is achievable at the same cell voltage when using a flow-through anode with forced-flow manifold electrolyte injection. For example, the U.S. Bureau of Mines, as reported in S. P. Sandoval, et al., "A Substituted Anode Reaction for Electrowinning Copper," Proceedings of Copper 95-COBRE 95 International Conference, v. III, pp. 423-435 (1995), achieved a current density of only about 258 A/m$^2$ (about 24.0 A/ft$^2$) in an experimental test wherein the electrowinning cell was operated continuously for five days with two conventional cathodes and three conventional anodes (i.e., non-flow-through anodes) and with a side-injection circulation manifold. The electrolyte flow rate was about 0.24 gpm/ft$^2$ and the electrolyte temperature was approximately 104° F. The iron concentration in the electrolyte measured approximately 28 g/L and the average cell voltage over the five-day test period was 0.94 V.

Results of experimental testing performed in accordance with an exemplary embodiment of the present invention, however, clearly demonstrate the benefits of the present invention over the prior art. In such testing, a current density of about 30 A/ft$^2$—twenty-five percent greater than the current density achieved in the U.S. Bureau of Mines testing—was achieved using an electrowinning cell with three conventional cathodes and four flow-through anodes (in this instance, titanium mesh anodes with an iridium oxide-based coating), and with a bottom-injection "floor mat" circulation manifold. Electrolyte iron concentration, electrolyte flow rate, temperature, and cell voltage were similar to those employed in the U.S. Bureau of Mines test.

Further illustrating the benefits of the present invention, EXAMPLE 1 herein demonstrates that cell voltages of about 1.0 V and about 1.25 V are achievable at current densities of about 35 A/ft$^2$ (377 A/m$^2$) and about 40 A/ft$^2$ (430 A/m$^2$), respectively.

In conventional electrowinning processes utilizing the decomposition of water anode reaction, electrolyte mixing and electrolyte flow through the electrochemical cell are achieved by circulating the electrolyte through the electrochemical cell and by the generation of oxygen bubbles at the anode, which cause agitation of the electrolyte solution as the oxygen bubbles rise to the surface of the electrolyte in the cell. However, because the ferrous/ferric anode reaction does not generate oxygen bubbles at the anode, electrolyte circulation is the primary source of mixing in the electrochemical cell. The present inventors have achieved an advancement in the art by recognizing that an electrochemical cell configured to allow a significant increase in mass transport of relevant species between the anode (e.g., ferrous/ferric ions) and the cathode (e.g., copper ions) by enhancing electrolyte flow and circulation characteristics when utilizing the alternative anode reaction would be advantageous.

Enhanced circulation of the electrolyte between the electrodes increases the rate of transport of ions to and from the electrode surfaces (for example, copper ions to the cathode, ferrous ions to the anode, and ferric ions away from the anode) and, as a result, generally decreases the overall cell voltage. Decreasing the cell voltage results in a decrease in the power demand for electrowinning. Enhancing circulation of the electrolyte, however, generally requires an increase in the power demand of the electrolyte pumping system. Thus, the objectives of decreasing cell voltage and increasing electrolyte circulation are preferably balanced. In accordance with one aspect of an exemplary embodiment of the invention, the total power requirement of the electrochemical cell may be optimized by minimizing the sum of the power required to circulate the electrolyte through the electrochemical cell and the power used to electrowin the copper at the cathode.

Referring now to FIG. 2, an electrochemical cell 200 in accordance with various aspects of an exemplary embodiment of the invention is provided. Electrochemical cell 200 generally comprises a cell 21, at least one anode 23, at least one cathode 25, and an electrolyte flow manifold 27 comprising a plurality of injection holes 29 distributed throughout at least a portion of the cell 21. In accordance with one aspect of an embodiment of the invention, electrochemical cell 200 comprises an exemplary apparatus for implementation of electrowinning step 101 of electrowinning process 100 illustrated in FIG. 1. These and other exemplary aspects are discussed in greater detail hereinbelow.

In accordance with one aspect of an exemplary embodiment of the present invention, anode 23 is configured to enable the electrolyte to flow through it. As used herein, the term "flow-through anode" refers to an anode so configured, in accordance with one embodiment of the invention.

Any now known or hereafter devised flow-through anode may be utilized in accordance with various aspects of the present invention. Possible configurations include, but are not limited to, metal wool or fabric, an expanded porous metal structure, metal mesh, multiple metal strips, multiple metal wires or rods, perforated metal sheets, and the like, or combinations thereof. Moreover, suitable anode configurations are not limited to planar configurations, but may include any suitable multiplanar geometric configuration.

While not wishing to be bound by any particular theory of operation, anodes so configured allow better transport of ferrous iron to the anode surface for oxidation, and better transport of ferric iron away from the anode surface. Accordingly, any configuration permitting such transport is within the scope of the present invention.

Anodes employed in conventional electrowinning operations typically comprise lead or a lead alloy, such as, for example, Pb—Sn—Ca. One disadvantage of such anodes is that, during the electrowinning operation, small amounts of lead are released from the surface of the anode and ultimately cause the generation of undesirable sediments, "sludges," particulates suspended in the electrolyte, or other corrosion products in the electrochemical cell and contamination of the copper cathode product. For example, copper cathode produced in operations employing a lead-containing anode typically comprises lead contaminant at a level of from about 1 ppm to about 4 ppm. Moreover, lead-containing anodes have a typical useful life limited to approximately four to seven years. In accordance with one aspect of a preferred embodiment of the present invention, the anode is substantially lead-free. Thus, generation of lead-containing sediments, "sludges," particulates suspended in the electrolyte, or other corrosion products and resultant contamination of the copper cathode with lead from the anode is avoided.

Preferably, in accordance with an exemplary embodiment of the present invention, the anode is formed of one of the so-called "valve" metals, including titanium (Ti), tantalum (Ta), zirconium (Zr), or niobium (Nb). The anode may also be formed of other metals, such as nickel, or a metal alloy, intermetallic mixture, or a ceramic or cermet containing one or more valve metals. For example, titanium may be alloyed with nickel (Ni), cobalt (Co), iron (Fe), manganese (Mn), or copper (Cu) to form a suitable anode. Preferably, the anode comprises titanium, because, among other things, titanium is rugged and corrosion-resistant. Titanium anodes, for example, when used in accordance with various aspects of embodiments of the present invention, potentially have useful lives of up to fifteen years or more.

The anode may also comprise any electrochemically active coating. Exemplary coatings include those provided from platinum, ruthenium, iridium, or other Group VIII metals, Group VIII metal oxides, or compounds comprising Group VIII metals, and oxides and compounds of titanium, molybdenum, tantalum, and/or mixtures and combinations thereof. Ruthenium oxide and iridium oxide are preferred for use as the electrochemically active coating on titanium anodes when such anodes are employed in connection with various embodiments of the present invention. In accordance with one embodiment of the invention, the anode is formed of a titanium metal mesh coated with an iridium-based oxide coating. In another embodiment of the invention, the anode is formed of a titanium mesh coated with a ruthenium-based oxide coating. Anodes suitable for use in accordance with various embodiments of the invention are available from a variety of suppliers.

Conventional copper electrowinning operations use either a copper starter sheet or a stainless steel or titanium "blank" as the cathode. In accordance with one aspect of an exemplary embodiment of the invention, the cathode is configured as a metal sheet. The cathode may be formed of copper, copper alloy, stainless steel, titanium, or another metal or combination of metals and/or other materials. As illustrated in FIG. 2 and as is generally well known in the art, the cathode 25 is typically suspended from the top of the electrochemical cell such that a portion of the cathode is immersed in the electrolyte within the cell and a portion (generally a relatively small portion, less than about twenty percent (20%) of the total surface area of the cathode) remains outside the electrolyte bath. The total surface area of the portion of the cathode that is immersed in the electrolyte during operation of the electrochemical cell is referred to herein, and generally in the literature, as the "active" surface area of the cathode. This is the portion of the cathode onto which copper is plated during electrowinning.

In accordance with various embodiments of the present invention, the cathode may be configured in any manner now known or hereafter devised by the skilled artisan.

In certain embodiments of the present invention, the effect of enhanced electrolyte circulation on the cathode reaction is to promote effective transfer of copper ions. In order to promote a cathode deposit that is of high quality, the electrolyte circulation system should promote effective diffusion of copper ions to the cathode surface. When the copper diffusion rate is sufficiently hindered, the crystal growth pattern can change to an unfavorable structure that may result in a rough cathode surface. Excessive cathode roughness can cause an increase in porosity that can entrain electrolyte, and thus impurities, in the cathode surface. An effective diffusion rate of copper is one that promotes favorable crystal growth for smooth, high quality cathodes. Higher current density requires a higher rate of copper transfer to the cathode surface. For production of high quality, commercially acceptable cathodes, the maximum practical current density is limited in part by the copper diffusion rate that promotes favorable crystal growth patterns. In the present invention, the electrolyte circulation system utilized in the electrochemical cell to facilitate the ionic transfer to or from the anode is also effective at promoting effective diffusion of copper ions to the cathode. For example, use of the flow through anode enhances the copper ion transfer to the cathode in a similar manner to the ferrous and ferric ion transfer to and from the anode.

In accordance with an exemplary embodiment of the present invention, the copper concentration in the electrolyte for electrowinning is advantageously maintained at a level of from about 20 to about 60 grams of copper per liter of electrolyte. Preferably, the copper concentration is maintained at a level of from about 30 to about 50 g/L, and more preferably, from about 40 to about 45 g/L. However, various aspects of the present invention may be beneficially applied to processes employing copper concentrations above and/or below these levels.

Generally speaking, any electrolyte pumping, circulation, or agitation system capable of maintaining satisfactory flow and circulation of electrolyte between the electrodes in an electrochemical cell such that the process specifications described herein are practicable may be used in accordance with various embodiments of the invention.

Injection velocity of the electrolyte into the electrochemical cell may be varied by changing the size and/or geometry of the holes through which electrolyte enters the electrochemical cell. For example, with reference to FIG. 2 wherein electrolyte flow manifold 27 is configured as tubing or piping inside cell 21 having injection holes 29, if the diameter of injection holes 29 is decreased, the injection velocity of the electrolyte is increased, resulting in, among other things, increased agitation of the electrolyte. Moreover, the angle of injection of electrolyte into the electrochemical cell relative to the cell walls and the electrodes may be configured in any way desired. Although an approximately vertical electrolyte injection configuration is illustrated in FIG. 2 for purposes of reference, any number of configurations of differently directed and spaced injection holes are possible. For example, although the injection holes represented in FIG. 2 are approximately parallel to one another and similarly directed, configurations comprising a plurality of opposing injection streams or intersecting injection streams may be beneficial in accordance with various embodiments of the invention.

Figure 3:
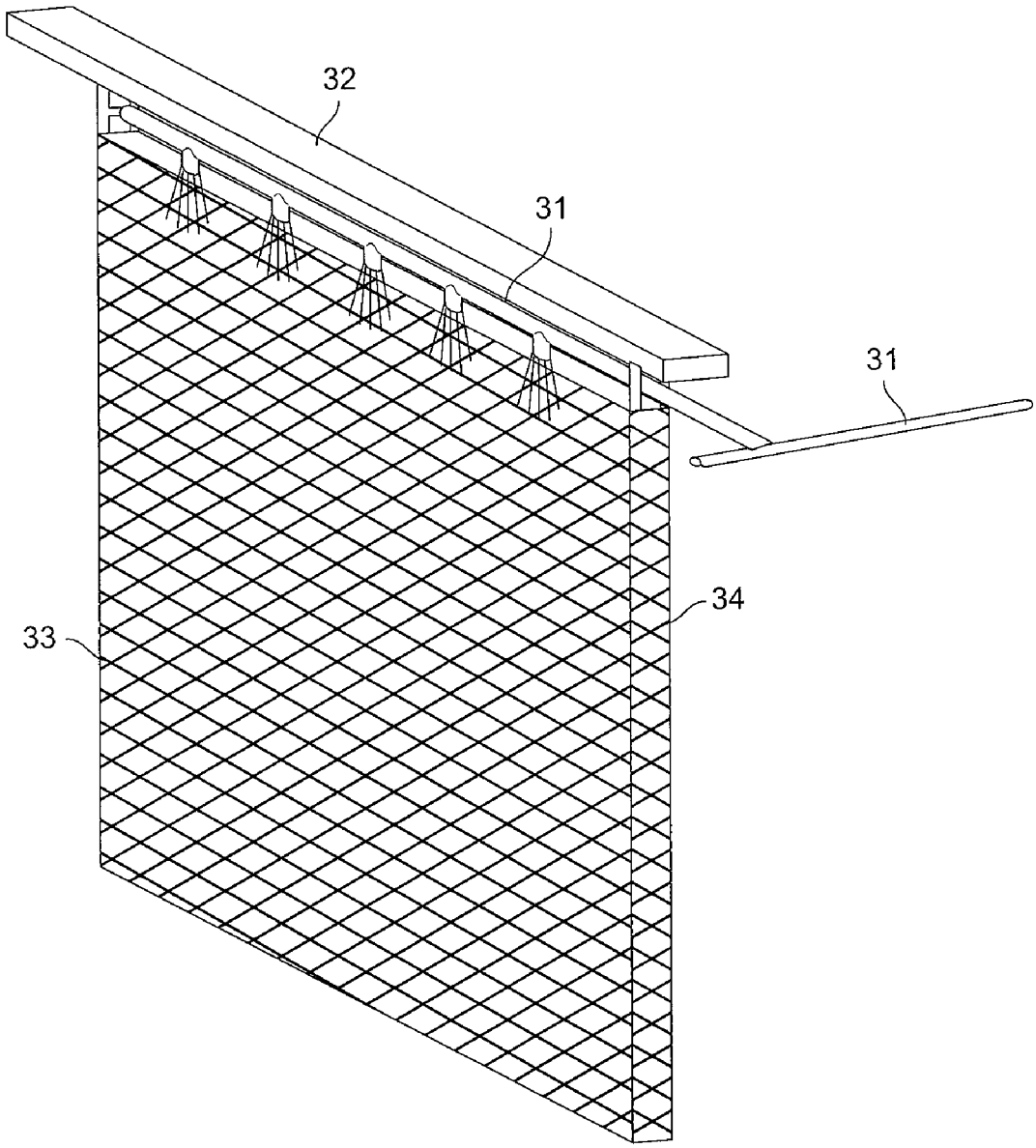
FIG. 3 illustrates an example of a flow-through anode with an example of an in-anode electrolyte injection manifold in accordance with an aspect of another exemplary embodiment of the present invention.
Figure 4:
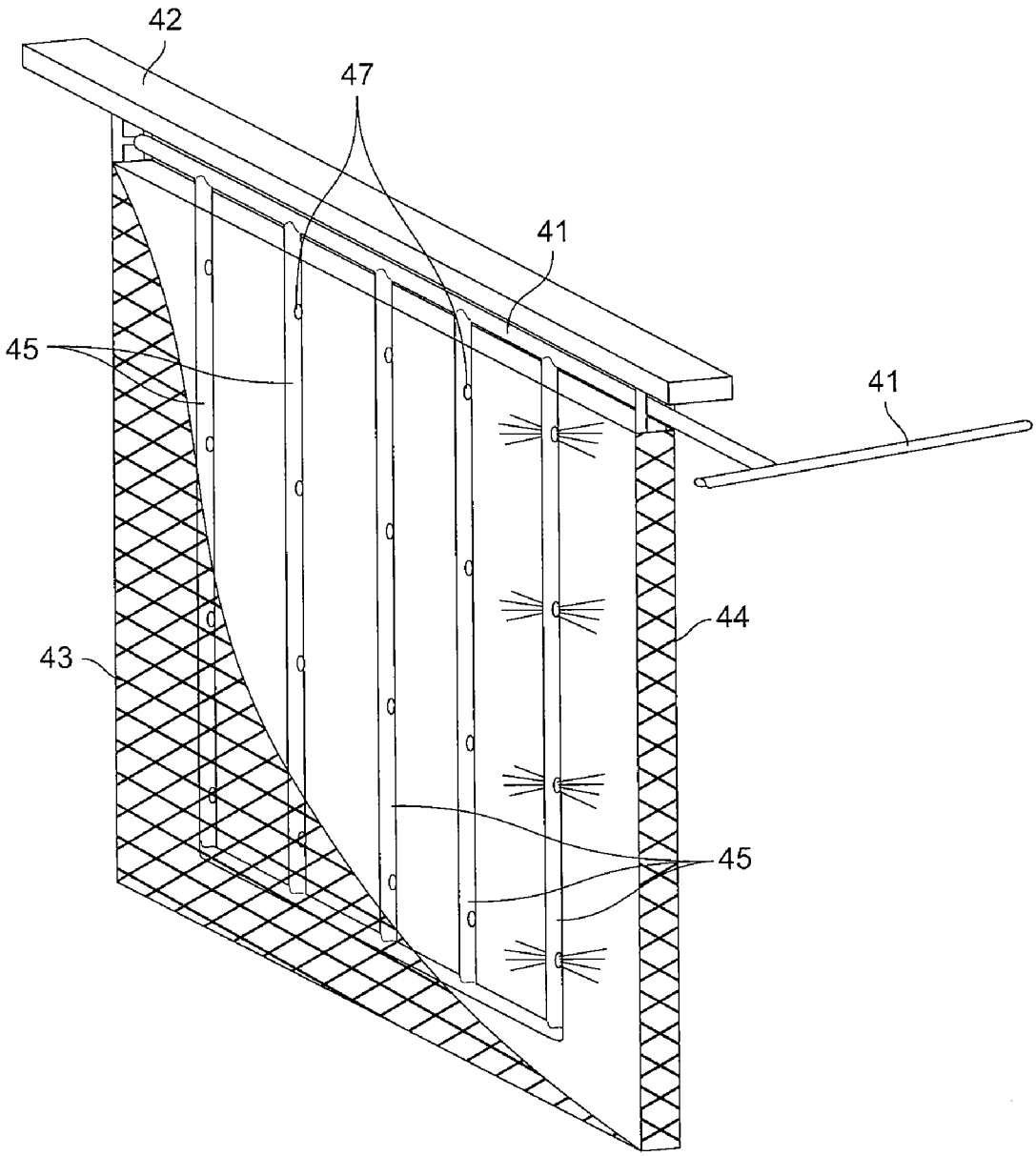
FIG. 4 illustrates yet another example of a flow-through anode with another example of an in-anode electrolyte injection manifold in accordance with an aspect of another exemplary embodiment of the present invention.

In accordance with one embodiment of the invention, the electrolyte flow manifold comprises tubing or piping suitably integrated with, attached to, or inside the anode structure, such as, for example, inserted between the mesh sides of an exemplary flow-through anode. Such an embodiment is illustrated, for example, in FIG. 3, wherein manifold 31 is configured to inject electrolyte between mesh sides 33 and 34 of anode 32. Yet another exemplary embodiment is illustrated in FIG. 4, wherein manifold 41 is configured to inject electrolyte between mesh sides 43 and 44 of anode 42. Manifold 41 includes a plurality of interconnected pipes or tubes 45 extending approximately parallel to the mesh sides 43 and 44 of anode 42 and each having a number of holes 47 formed therein for purposes of injecting electrolyte into anode 42, preferably in streams flowing approximately parallel to mesh sides 43 and 44, as indicated in FIG. 4.

In accordance with another embodiment of the invention, the electrolyte flow manifold comprises an exposed "floor mat" type manifold, generally comprising a group of parallel pipes situated length-wise along the bottom of the cell. Details of an exemplary manifold of such configuration are disclosed in the Examples herein.

In accordance with yet another embodiment of the invention, the high flow rate and forced-flow electrolyte flow manifold is integrated into or attached to opposite side walls and/or the bottom of the electrochemical cell, such that, for example, the electrolyte injection streams are oppositely directed and parallel to the electrodes. Other configurations are, of course, possible.

In accordance with various embodiments of the present invention, any electrolyte flow manifold configuration that provides an electrolyte flow effective to transport ferrous iron to the anode, to transport ferric iron from the anode, and to transport copper ions to the cathode such that the electrowinning cell may be operated at a cell voltage of less than about 1.5 V and at a current density of greater than about 26 A/ft$^2$, is suitable.

In accordance with an exemplary embodiment of the invention, electrolyte flow rate is maintained at a level of from about 0.1 gallons per minute per square foot of active cathode (about 4.0 L/min/m$^2$) to about 1.0 gallons per minute per square foot of active cathode (about 40.0 L/min/m$^2$). Preferably, electrolyte flow rate is maintained at a level of from about 0.1 gallons per minute per square foot of active cathode (about 4.0 L/min/m$^2$) to about 0.25 gallons per minute per square foot of active cathode (about 10.0 L/min/m$^2$). It should be recognized, however, that the optimal operable electrolyte flow rate useful in accordance with the present invention will depend upon the specific configuration of the process apparatus, and thus flow rates in excess of about 1.0 gallons per minute per square foot of active cathode (in excess of about 40.0 L/min/m$^2$) or less than about 0.1 gallons per minute per square foot of active cathode (less than about 4.0 L/min/m$^2$) may be optimal in accordance with various embodiments of the present invention.

Generally, as the operating temperature of the electrochemical cell (e.g., the electrolyte) increases, better plating at the cathode is achievable. While not wishing to be bound by any particular theory, it is believed that elevated electrolyte temperatures provide additional reaction energy and may provide a thermodynamic reaction enhancement that, at constant cell voltage, results in enhanced copper diffusion in the electrolyte as temperature is increased. Moreover, increased temperature also may enhance ferrous diffusion, and can result in overall reduction of the cell voltage, which in turn results in greater economic efficiency. EXAMPLE 2 demonstrates a decrease in cell voltage with increasing electrolyte temperature. Conventional copper electrowinning cells typically operate at temperature from about 115° F. to about 125° F. (from about 46° C. to about 52° C.).

In accordance with one aspect of an exemplary embodiment of the present invention, the electrochemical cell is operated at a temperature of from about 110° F. to about 180° F. (from about 43° C. to about 83° C.). Preferably, the electrochemical cell is operated at a temperature above about 115° F. (about 46° C.) or about 120° F. (about 48° C.), and preferably at a temperature below about 140° F. (about 60° C.) or about 150° F. (about 65° C.). However, in certain applications, temperatures in the range of about 155° F. (about 68° C.) to about 165° F. (about 74° C.) may be advantageous.

It should be recognized, however, that while higher operating temperatures may be beneficial for the reasons outlined above, operation at such higher temperatures may require the use of materials of construction designed and selected to satisfactorily withstand the more rigorous operating conditions. In addition, operation at higher temperatures may require increased energy demands.

The operating temperature of the electrochemical cell may be controlled through any one or more of a variety of means well known in the art, including, for example, an immersion heating element, an in-line heating device (e.g., a heat exchanger), or the like, preferably coupled with one or more feedback temperature control means for efficient process control.

A smooth plating surface is optimal for cathode quality and purity, because a smooth cathode surface is more dense and has fewer cavities in which electrolyte can become entrained, thus introducing impurities to the surface. Although it is preferable that the current density and electrolyte flow rate parameters be controlled such that a smooth cathode plating surface is achievable, operating the electrochemical cell at a high current density may nonetheless tend to result in a rough cathode surface. Thus, in accordance with one aspect of an exemplary embodiment of the present invention, an effective amount of a plating reagent is added to the electrolyte stream to enhance the plating characteristics—and thus the surface characteristics—of the cathode, resulting in improved cathode purity. Any plating reagent effective in improving the plating surface characteristics, namely, smoothness and porosity, of the cathode may be used. For example, suitable plating reagents (sometimes called "smoothing agents") may include thiourea, guar gums, modified starches, polyacrylic acid, polyacrylate, chloride ion, and/or combinations thereof may be effective for this purpose. When used, an effective concentration of the plating reagent in the electrolyte—or, stated another way, the effective amount of plating reagent required—invariably will depend upon the nature of the particular plating reagent employed; however, the plating reagent concentration generally will be in the range of from about 20 grams of plating reagent per tonne of copper plated to about 1000 g/tonne.

As ferrous iron is oxidized at the anode in the electrochemical cell, the concentration of ferrous iron in the electrolyte is naturally depleted, while the concentration of ferric iron in the electrolyte is naturally increased. In accordance with one aspect of an exemplary embodiment of the invention, the concentration of ferrous iron in the electrolyte is controlled by addition of ferrous sulfate to the electrolyte. In accordance with another embodiment of the invention, the concentration of ferrous iron in the electrolyte is controlled by solution extraction (SX) of iron from copper leaching solutions.

In order for the ferrous/ferric couple to maintain a continuous anode reaction, the ferric iron generated at the anode preferably is reduced back to ferrous iron to maintain a satisfactory ferrous concentration in the electrolyte. Additionally, the ferric iron concentration preferably is controlled to achieve satisfactory current efficiency in the electrochemical cell.

In accordance with an exemplary embodiment of the present invention, the total iron concentration in the electrolyte is maintained at a level of from about 10 to about 60 grams of iron per liter of electrolyte. Preferably, the total iron concentration in the electrolyte is maintained at a level of from about 20 g/L to about 40 g/L, and more preferably, from about 25 g/L to about 35 g/L. It is noted, however, that the total iron concentration in the electrolyte may vary in accordance with various embodiments of the invention, as total iron concentration is a function of iron solubility in the electrolyte. Iron solubility in the electrolyte varies with other process parameters, such as, for example, acid concentration, copper concentration, and temperature. As explained hereinabove, decreasing iron concentration in the electrolyte is generally economically desirable, because doing so decreases iron make-up requirements and decreases the electrolyte sulfate saturation temperature, and thus decreases the cost of operating the electrowinning cell.

In accordance with an exemplary embodiment of the present invention, the ferric iron concentration in the electrolyte is maintained at a level of from about 0.001 to about 10 grams of ferric iron per liter of electrolyte. Preferably, the ferric iron concentration in the electrolyte is maintained at a level of from about 1 g/L to about 6 g/L, and more preferably, from about 2 g/L to about 4 g/L.

Referring again to FIG. 1, in accordance with another aspect of an exemplary embodiment of the invention, the concentration of ferric iron in the electrolyte within the electrochemical cell is controlled by removing at least a portion of the electrolyte from the electrochemical cell, for example, as illustrated in FIG. 1 as electrolyte regeneration stream 15 of process 100.

In accordance with one aspect of an exemplary embodiment of the invention, sulfur dioxide 17 may be used to reduce the ferric iron in electrolyte regeneration stream 15. Although reduction of $Fe^{3+}$ to $Fe^{2+}$ in electrolyte regeneration stream 15 in ferrous regeneration stage 103 may be accomplished using any suitable reducing reagent or method, sulfur dioxide is particularly attractive as a reducing agent for $Fe^{3+}$ because it is generally available from other copper processing operations, and because sulfuric acid is generated as a byproduct. Upon reacting with ferric iron in a copper-containing electrolyte, the sulfur dioxide is oxidized, forming sulfuric acid. The reaction of sulfur dioxide with ferric iron produces two moles of sulfuric acid for each mole of copper produced in the electrochemical cell, which is one mole more of acid than is typically required to maintain the acid balance within the overall copper extraction process, when solution extraction (SX) is used in conjunction with electrowinning. The excess sulfuric acid may be extracted from the acid-rich electrolyte (illustrated in FIG. 1 as stream 18) generated in the ferrous regeneration stage for use in other operations, such as, for example, leaching operations.

With reference to FIG. 1, the acid-rich electrolyte stream 18 from ferrous regeneration stage 103 may be returned to electrowinning stage 101 via electrolyte recycle streams 12 and 16, may be introduced to acid removal stage 105 for further processing, or may be split (as shown in FIG. 1) such that a portion of acid-rich electrolyte stream 18 returns to electrowinning stage 101 and a portion continues to acid removal stage 105. In acid removal stage 105, excess sulfuric acid is extracted from the acid-rich electrolyte and leaves the process via acid stream 19, to be neutralized or, preferably, used in other operations, such as, for example a heap leach operation. The acid-reduced electrolyte stream 14 may then be returned to electrowinning stage 101 via electrolyte recycle stream 16, as shown in FIG. 1.

In sum, copper electrowinning using the ferrous/ferric anode reaction in accordance with one embodiment of the present invention produces two products—cathode copper and sulfuric acid.

In accordance with another aspect of an exemplary embodiment of the invention, the ferric-rich electrolyte is contacted with sulfur dioxide in the presence of a catalyst, such as, for example, activated carbon manufactured from bituminous coal, or other types of carbon with a suitable active surface and suitable structure. The reaction of sulfur dioxide and ferric iron is preferably monitored such that the concentration of ferric iron and ferrous iron in the acid-rich electrolyte stream produced in the ferrous regeneration stage can be controlled. In accordance with an aspect of another embodiment of the invention, two or more oxidation-reduction potential (ORP) sensors are used—at least one ORP sensor in the ferric-rich electrolyte line upstream from the injection point of sulfur dioxide, and at least one ORP sensor downstream from the catalytic reaction point in the ferric-lean electrolyte. The ORP measurements provide an indication of the ferric/ferrous ratio in the solution; however, the exact measurements depend on overall solution conditions that may be unique to any particular application. Those skilled in the art will recognize that any number of methods and/or apparatus may be utilized to monitor and control the ferric/ferrous ratio in the solution. The ferric-rich electrolyte will contain from about 0.001 to about 10 grams per liter ferric iron, and the ferric-lean electrolyte will contain up to about 6 grams per liter ferric iron.

The following examples illustrate, but do not limit, the present invention.

EXAMPLE 1

TABLE 1 demonstrates the advantages of a flow-through anode with in-anode electrolyte injection for achieving low cell voltage. An in-anode manifold produces a lower cell voltage at the same flow or decreases flow requirements at the same current density versus bottom injection. TABLE 1 also demonstrates that a cell voltage below 1.10 V is achievable at a current density of about 35 A/ft$^2$ (377 A/m$^2$) and a cell voltage below 1.25 V is achievable at a current density of about 40 A/ft$^2$ (430 A/m$^2$).

Test runs A-F were performed using an electrowinning cell of generally standard design, comprising three full-size conventional cathodes and four full-size flow-through anodes. The cathodes were constricted of 316 stainless steel and each had an active depth of 41.5 inches and an active width of 37.5 inches (total active surface area of 21.6 ft$^2$ per cathode). Each anode had an active width of 35.5 inches and an active depth of 39.5 inches and was constructed of titanium mesh with an iridium oxide-based coating. The anodes used in accordance with this EXAMPLE 1 were obtained from Republic Anode Fabricators of Strongsville, Ohio, USA.

Test duration was five days (except test runs C, D, E and F, which were 60-minute tests designed to measure voltage only, at constant conditions), with continuous 24-hour operation of the electrowinning cell at approximately constant conditions. Voltage measurements were taken once per day using a handheld voltage meter and voltages were measured bus-to-bus. The stated values for average cell voltage in TABLE 1 represent the average voltage values over the six-day test period. Electrolyte flow measurements were performed by a continuous electronic flow meter (Magmeter), and all electrolyte flow rates in TABLE 1 are shown as gallons per minute of electrolyte per square foot of cathode plating area. The plating reagent utilized in all test runs was PD 4201 modified starch, obtained from Chemstar from Minneapolis, Minn. The concentration of plating reagent in the electrolyte was maintained in the range of 250-450 grams per plated ton of copper.

Electrolyte temperature was controlled using an automatic electric heater (Chromalox). Iron addition to the electrolyte was performed using ferrous sulfate crystals (18% iron). Copper and iron concentration assays were performed using standard atomic absorption tests. Copper concentration in the electrolyte was maintained at a level of about 41-46 g/L using solution extraction.

The concentration of sulfuric acid in the electrolyte was maintained at a level of about 150-160 g/L using an Eco-Tec sulfuric acid extraction unit (acid retardation process).

The current to each electrowinning cell was set using a standard rectifier. The operating current density for each test run was calculated by dividing the total Amps on the rectifier setting by the total cathode plating area (i.e., 64.8 ft$^2$).

Ferrous regeneration was accomplished using sulfur dioxide gas, which was injected into an electrolyte recycle stream, then passed through an activated carbon bed in order to catalyze the ferric reduction reaction. The reaction was controlled using ORP sensors, which measured ORP in the range of 390 to 410 mV (versus standard silver chloride reference junction). Sufficient sulfur dioxide was injected into the electrolyte recycle stream such that the ORP was maintained within the range of 390 to 410 mV.

Average copper production rate for test runs A and B, which were operated at a current density of 30 A/ft$^2$, was 112 lbs. per day. The copper cathode produced for test runs A and B measured less than 0.3 ppm lead and less than 5 ppm sulfur. Copper purity did not vary overall according to the specific test conditions employed. Copper assays on test runs C-F were not performed because of the relatively short test duration.

Test runs A, C, and E were performed using a bottom-injection "floor mat" injection manifold configuration. The bottom-injection manifold included eleven 1" diameter PVC pipes configured to run the length of the electrowinning cell (i.e., approximately perpendicular to the active surfaces of the electrodes). Each of the eleven pipes positioned one 3/16" diameter hole in each electrode gap (i.e., there were eleven holes approximately evenly spaced within each electrode gap).

Test runs A, D, and F were performed using an in-anode injection manifold configuration. The in-anode injection manifold was configured using a distribution supply line adjacent to the electrodes, with direct electrolyte supply lines comprising 3/8" ID×1/2" OD or 1/4" ID×3/8" OD polypropylene tubing branching from the distribution supply line and leading to each anode. Each electrolyte supply line included five equally-spaced dropper tubes that branched from the electrolyte supply line and were positioned to inject electrolyte directly into the anode, between the mesh surfaces of the anode. No electrolyte injection occurred directly adjacent to the cathodes.

using a handheld voltage meter and voltages were measured bus-to-bus. The stated values for average cell voltage in TABLE 2 represent the average voltage values over the six-day test period. Electrolyte flow measurements were performed by a continuous electronic flow meter (Magmeter), and all electrolyte flow rates in TABLE 2 are shown as gallons per minute of electrolyte per square foot of cathode plating area. The plating reagent utilized in all test runs was PD 4201 modified starch, obtained from Chemstar from Minneapolis, Minn. The concentration of plating reagent in the electrolyte was maintained in the range of 250-450 grams per plated ton of copper.

Electrolyte temperature was controlled using an automatic electric heater (Chromalox). Iron addition to the electrolyte was performed using ferrous sulfate crystals (18% iron). Copper and iron concentration assays were performed using standard atomic absorption tests. Copper concentration in the electrolyte was maintained at a level of about 41-46 g/L using solution extraction.

The concentration of sulfuric acid in the electrolyte was maintained at a level of about 150-160 g/L using an Eco-Tec sulfuric acid extraction unit (acid retardation process).

The current to each electrowinning cell was set using a standard rectifier. The operating current density for each test run was calculated by dividing the total Amps on the rectifier setting by the total cathode plating area (i.e., 64.8 ft$^2$).

Ferrous regeneration was accomplished using sulfur dioxide gas, which was injected into an electrolyte recycle stream, then passed through an activated carbon bed in order to catalyze the ferric reduction reaction. The reaction was controlled using ORP sensors, which measured ORP in the range of 390 to 410 mV (versus standard silver chloride reference junc-

TABLE 1

| Test | Cathode Current Density, A/ft$^2$ | Electrolyte Manifold Distributor Design | Electrolyte Iron Conc., g/L | Electrolyte Flow, gpm/ft$^2$ | Electrolyte Temperature, ° F. | Average Cell Voltage, V |
|---|---|---|---|---|---|---|
| A | 30 | Bottom Injection | 25.5 | 0.41 | 125 | 0.95 |
| B | 30 | In-Anode Injection | 25.5 | 0.41 | 125 | 0.90 |
| C | 35 | Bottom Injection | 28 | 0.66 | 125 | 1.02 |
| D | 35 | In-Anode Injection | 28 | 0.24 | 125 | 1.10 |
| E | 40 | Bottom Injection | 28 | 0.66 | 125 | 1.12 |
| F | 40 | In-Anode Injection | 28 | 0.24 | 125 | 1.25 |

EXAMPLE 2

TABLE 2 demonstrates that increasing temperature decreases cell voltage.

Test runs A-C were performed using an electrowinning cell of generally standard design, comprising three full-size conventional cathodes and four full-size flow-through anodes. The cathodes were constructed of 316 stainless steel and each had an active depth of 41.5 inches and an active width of 37.5 inches (total active surface area of 21.6 ft$^2$ per cathode). Each anode had an active width of 35.5 inches and an active depth of 39.5 inches and was constructed of titanium mesh with an iridium oxide-based coating. The anodes used in accordance with this EXAMPLE 2 were obtained from Republic Anode Fabricators of Strongsville, Ohio, USA.

Test duration was six days, with continuous 24-hour operation of the electrowinning cell at approximately constant conditions. Voltage measurements were taken once per day tion). Sufficient sulfur dioxide was injected into the electrolyte recycle stream such that the ORP was maintained within the range of 390 to 410 mV.

Average copper production rate for all test runs, which were operated at a current density of 30 A/ft$^2$, was 112 lbs. per day. The copper cathode produced for all test runs generally measured less than 0.3 ppm lead and less than 5 ppm sulfur. Copper purity did not vary overall according to the specific test conditions employed.

Test runs were performed using a bottom-injection "floor mat" injection manifold configuration. The bottom-injection manifold included eleven 1" diameter PVC pipes configured to run the length of the electrowinning cell (i.e., approximately perpendicular to the active surfaces of the electrodes). Each of the eleven pipes positioned one 3/16" diameter hole in each electrode gap (i.e., there were eleven holes approximately evenly spaced within each electrode gap).

TABLE 2

| Test | Cathode Current Density, A/ft$^2$ | Electrolyte Manifold Distributor Design | Electrolyte Iron Conc., g/L | Electrolyte Flow, gpm/ft$^2$ | Electrolyte Temperature, ° F. | Average Cell Voltage, V |
|---|---|---|---|---|---|---|
| A | 30 | Bottom Injection | 28.6 | 0.28 | 125 | 0.92 |
| B | 30 | Bottom Injection | 27.2 | 0.28 | 135 | 0.88 |
| C | 30 | Bottom Injection | 26.9 | 0.28 | 125 | 0.95 |

An effective and efficient method of copper electrowinning using the ferrous/ferric-sulfur dioxide anode reaction has been presented herein. Further, the present inventors have advanced the art of copper hydrometallurgy by recognizing the advantages of using the ferrous/ferric anode reaction in connection with copper electrowinning processes, and have developed an improved system for utilizing the ferrous/ferric anode reaction to achieve greater efficiency over conventional copper electrowinning processes.

The present invention has been described above with reference to a number of exemplary embodiments and examples. It should be appreciated that the particular embodiments shown and described herein are illustrative of the invention and its best mode and are not intended to limit in any way the scope of the invention as set forth in the claims. Those skilled in the art having read this disclosure will recognize that changes and modifications may be made to the exemplary embodiments without departing from the scope of the present invention. These and other changes or modifications are intended to be included within the scope of the present invention, as expressed in the following claims.

The invention claimed is:

1. A system for electrowinning copper from a copper-containing electrolyte, comprising:

an electrowinning cell comprising at least one flow-through anode, at least one plate cathode, a floor, and a ceiling; and a plurality of injection holes located on at least one of said floor and said ceiling;

wherein said copper-containing electrolyte comprises solubilized ferrous iron.

2. The system according to claim 1, further comprising an electrolyte flow manifold.

3. The system according to claim 1, wherein said at least one flow-through anode further comprises a metallic mesh.

4. The system according to claim 2, wherein said electrolyte flow manifold is configured to provide electrolyte flow through said plurality of injection holes.

5. The system according to claim 3, wherein said metallic mesh encases at least one of said plurality of injection holes.

6. The system according to claim 3, wherein said metallic mesh further comprises an electrochemically active coating.

7. The system according to claim 1, wherein said at least one plate cathode has an active surface area.

8. The system according to claim 1, wherein said electrowinning cell is configured to be operated at a predetermined cell voltage and at a predetermined current density, wherein said cell voltage is less than about 1.5 Volts and wherein said current density is greater than about 26 amperes per square foot of active plate cathode.

* * * * *